US008409023B1

(12) United States Patent
Hogan

(10) Patent No.: US 8,409,023 B1
(45) Date of Patent: Apr. 2, 2013

(54) GOLF BALL DISPENSING AND TEEING DEVICE

(76) Inventor: Dave W. Hogan, Myrtle Beach, SC (US)

( * ) Notice: Subject to any disclaimer, the term of this patent is extended or adjusted under 35 U.S.C. 154(b) by 489 days.

(21) Appl. No.: 12/661,762

(22) Filed: Mar. 23, 2010

Related U.S. Application Data

(63) Continuation-in-part of application No. 11/900,866, filed on Sep. 13, 2007, now abandoned.

(51) Int. Cl.
*A63B 57/00* (2006.01)

(52) U.S. Cl. ..... 473/132; 473/137; 473/278; 473/405

(58) Field of Classification Search ..... 473/132–137, 473/278, 279, 386, 405
See application file for complete search history.

(56) References Cited

U.S. PATENT DOCUMENTS 1,937,180 A * 11/1933 Young ..... 473/137
1,940,321 A 12/1933 Pagett
3,458,204 A * 7/1969 Wilson ..... 473/134
4,253,668 A * 3/1981 Ose ..... 473/132
5,110,133 A * 5/1992 Durso ..... 473/218
5,259,622 A * 11/1993 Irving ..... 473/132
5,335,953 A 8/1994 Luther, Sr.
5,356,148 A * 10/1994 Elder, Jr. ..... 473/133
5,411,267 A 5/1995 Burks et al.
5,529,307 A 6/1996 Chang
5,572,761 A * 11/1996 Meyer ..... 15/21.2
5,647,805 A 7/1997 Tarbox, Jr.
5,665,004 A 9/1997 Vlahovic
5,673,812 A 10/1997 Nelson
5,674,130 A 10/1997 Egan
5,704,844 A 1/1998 Luther
6,328,659 B1 12/2001 Peterson
6,371,330 B1 4/2002 Knez
6,929,556 B1 * 8/2005 Wolbert ..... 473/137

OTHER PUBLICATIONS www.uprightgolf.com/practice-aids.html, copyright 2005.

* cited by examiner

*Primary Examiner* — Gene Kim
*Assistant Examiner* — Joseph B Baldori
(74) *Attorney, Agent, or Firm* — P. Jeff Martin; The Law Firm of P. Jeffrey Martin, LLC

(57) ABSTRACT

A golf ball dispensing and teeing device is provided which allows a single golf ball to be metered from a supply tube and travel therefrom to rest within an elevated ball tee.

18 Claims, 8 Drawing Sheets

GOLF BALL DISPENSING AND TEEING DEVICE

RELATED APPLICATIONS

The present invention is a Continuation in Part of Ser. No. 11/900,866, filed on Sep. 13, 2007 now abandoned.

BACKGROUND OF THE INVENTION

1. Field of the Invention

The present invention relates generally to golf equipment and, more particularly, to a golf ball dispensing and teeing device.

2. Description of the Related Art

Numerous golf ball teeing devices and machines have been suggested in the past. Generally, the majority of such devices are complex, cumbersome, and are intended for permanent installation on a driving range or other large area.

Accordingly, a need has arisen for a lightweight, durable, portable golf ball dispensing and teeing device configured to allow a single golf ball to be metered onto an elevated tee in a manner which is quick, easy, and efficient. The development of the golf ball dispensing and teeing device fulfills this need.

A search of the prior art did not disclose any patents that read directly on the claims of the instant invention; however, the following references were considered related.

The following patents disclose various golf ball dispensers and teeing devices:

U.S. Pat. No. 5,529,307, issued in the name of Chang;
U.S. Pat. No. 5,335,953, issued in the name of Luther, Sr.;
U.S. Pat. No. 5,647,805, issued in the name of Tarbox, Jr.;
U.S. Pat. No. 1,940,321, issued in the name of Pagett;
U.S. Pat. No. 5,665,004, issued in the name of Vlahovic;
U.S. Pat. No. 5,673,812, issued in the name of Nelson;
U.S. Pat. No. 5,674,130, issued in the name of Egan;
U.S. Pat. No. 5,411,267, issued in the name of Burks et al.;
U.S. Pat. No. 5,704,844, issued in the name of Luther;
U.S. Pat. No. 6,328,659 B1, issued in the name of Peterson; and
U.S. Pat. No. 6,371,330 B1, issued in the name of Knez.

Consequently, a need has been felt for an improved golf ball dispensing and teeing device capable of housing a plurality of balls and configured to permit a single golf ball to be metered onto an elevated tee in a manner which is quick, easy, and efficient.

SUMMARY OF THE INVENTION

Therefore, it is an object of the present invention to provide a device adapted to permit a single golf ball to be metered from a ball supply tube and travel therefrom into a ball seat.

It is another object of the present invention to provide a lightweight, rigid device constructed so as to be easily transportable.

It is another object of the present invention to provide an anchor means for anchoring the device securely to the ground.

It is another object of the present invention to provide a loading assembly having a ball seat configured to be elevated above ground during use.

It is another object of the present invention to provide a ball release mechanism adapted to permit a single golf ball to be metered from the ball supply tube.

It is another object of the present invention to provide a ball retrieval mechanism configured for picking up golf balls one at a time.

It is still another object of the present invention to provide a hopper for holding a supply of golf balls, the hopper being releasably locked to the lower end of the ball supply tube.

It is yet another object of the present invention to provide a golf ball dispensing and teeing device adapted to be anchored to the ground in an elevationally-declined orientation so that golf balls feed by gravity from the ball supply tube to the ball seat.

Briefly described according to one embodiment of the present invention, a golf ball dispensing and teeing device is disclosed. The device comprises an elongated ball supply tube fabricated of a lightweight, rigid material and is adapted to hold a plurality of golf balls. The ball supply tube is cylindrical and has an inner diameter being slightly larger than a diametrical measure of a standard golf ball, thereby allowing a plurality of golf balls to feed into ball supply tube in single file and stacked formation prior to being released onto a loading arm assembly. The ball supply tube is anchored to the ground in an elevationally-declined orientation with respect thereto via an anchor mechanism so that golf balls feed by gravity from tube to a ball seat of the loading arm assembly.

The anchor mechanism comprises a pair of generally C-shaped members which includes an anterior member and a posterior member. Each C-shaped member includes a horizontal member having opposed ends from which legs extend integrally downward therefrom. Each leg tapers into a lower pointed end so as to facilitate insertion into the ground. The anterior member and posterior member are rotatably disposed within a front and rear support bracket respectively. The anterior and posterior members can be locked into a desired position via a manually adjustable screw.

The loading arm assembly comprises defines a unitary design comprising an elongated body, the elongated body having an upper surface, a lower surface, opposing sides, and a lower end opposing a forward end, the forward end defining a ball seat. The ball seat defines a diameter being sufficient so as to allow a standard golf ball to rest immobilized therein. The elongated body is secured to the front support bracket in such a manner so as to extend outwardly from a lower plane of the anterior end of ball supply tube and to be elevated above the ground in a declined position when the present invention is anchored to the ground.

The upper surface of elongated body defines a concave channel formed therein and extending longitudinally theredown so as to form parallel side rails. The parallel side rails are suitably spaced so as to allow a golf ball to roll downwardly there along towards ball seat.

The elongated body is fabricated of a resiliently flexible material. The fabrication material is sufficiently rigid such that parallel side rails maintain an elongated, rigid position while ball seat supports a golf ball, and sufficiently flexible so as to nutate laterally upon striking the golf ball, after which parallel side rails resume an elongated, rigid position.

A ball release mechanism is provided in order to facilitate controlled golf ball release from ball supply tube. The ball release mechanism is adapted to permit a single golf ball to be metered from the ball supply tube. The ball release mechanism comprises an upper elongated jaw portion hingedly attached via a spring to a lower elongated jaw portion. The lower elongated jaw portion has a bottom side welded or otherwise suitably mounted to the upper circumferential sidewall of ball supply tube proximal to the anterior end thereof. The spring is urged in a manner such that the front end of upper elongated jaw portion is biased downwardly in a resting position. This configuration allows the upper elongated jaw portion to pivot between a first generally declined position and a second generally horizontal position.

The front end of upper elongated jaw portion overhangs the lower elongated jaw portion so as to allow an elongated abutment member to extend downwardly through a circular opening in ball supply tube. The elongated abutment member extends downward angularly from the upper elongated jaw portion along the front end thereof. In a resting position, elongated abutment member extends a linear distance through the circular opening defined through the upper circumferential sidewall of ball supply tube, wherein circular opening is positioned fore of lower elongated jaw portion. When ball release mechanism is in a resting position, the elongated abutment member thereof engages a first golf ball of a series of golf balls positioned in single file and stacked formation within ball supply tube, and prevents forward movement by the first golf ball. Elongated abutment member functions as a stop to prevent a golf ball(s) from dispensing from the ball supply tube. In order to release a single golf ball through the anterior end of ball supply tube, the rearward end of upper elongated jaw portion is depressed using the club head of a golf club, thereby concurrently urging elongated abutment member upwardly and causing abutment member to disengage from the first golf ball which allows first golf ball to exit the ball supply tube, roll slowly down the parallel side rails and into the ball seat, within which golf ball resides in a resting position.

The ball release mechanism further comprises a stop member which limits the second generally horizontal position of upper elongated jaw portion. The stop member is mounted atop the lower elongated jaw portion, posterior to spring and underneath upper elongated jaw portion. The stop member is configured to make contact with upper elongated jaw portion when upper elongated jaw portion is lowered a sufficient distance.

A hopper is provided for holding a supply of golf balls. The hopper is releasably locked to the posterior end of the ball supply tube.

An alternate embodiment of the present invention is provided, wherein ball release mechanism comprises a spring-biased U-bolt assembly operable by the depression of a club head engaging pedal. Depression of the club head engaging pedal concurrently urges an abutment element downwardly, thereby causing abutment element to disengage from a first golf ball, and allowing first golf ball to exit the anterior end of ball supply tube, roll slowly down the parallel side rails and into ball seat, within which golf ball resides in a resting position.

A ball retrieval mechanism is provided, wherein ball retrieval mechanism is mounted to the open posterior end of ball supply tube. The ball retrieval mechanism is configured for picking up golf balls one at a time. Once a golf ball is retrieved using the mechanism, the golf ball is released therefrom into the hollow interior of ball supply tube.

The use of the present invention allows a single golf ball to be metered from a supply tube and travel therefrom to rest atop an elevated ball seat in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
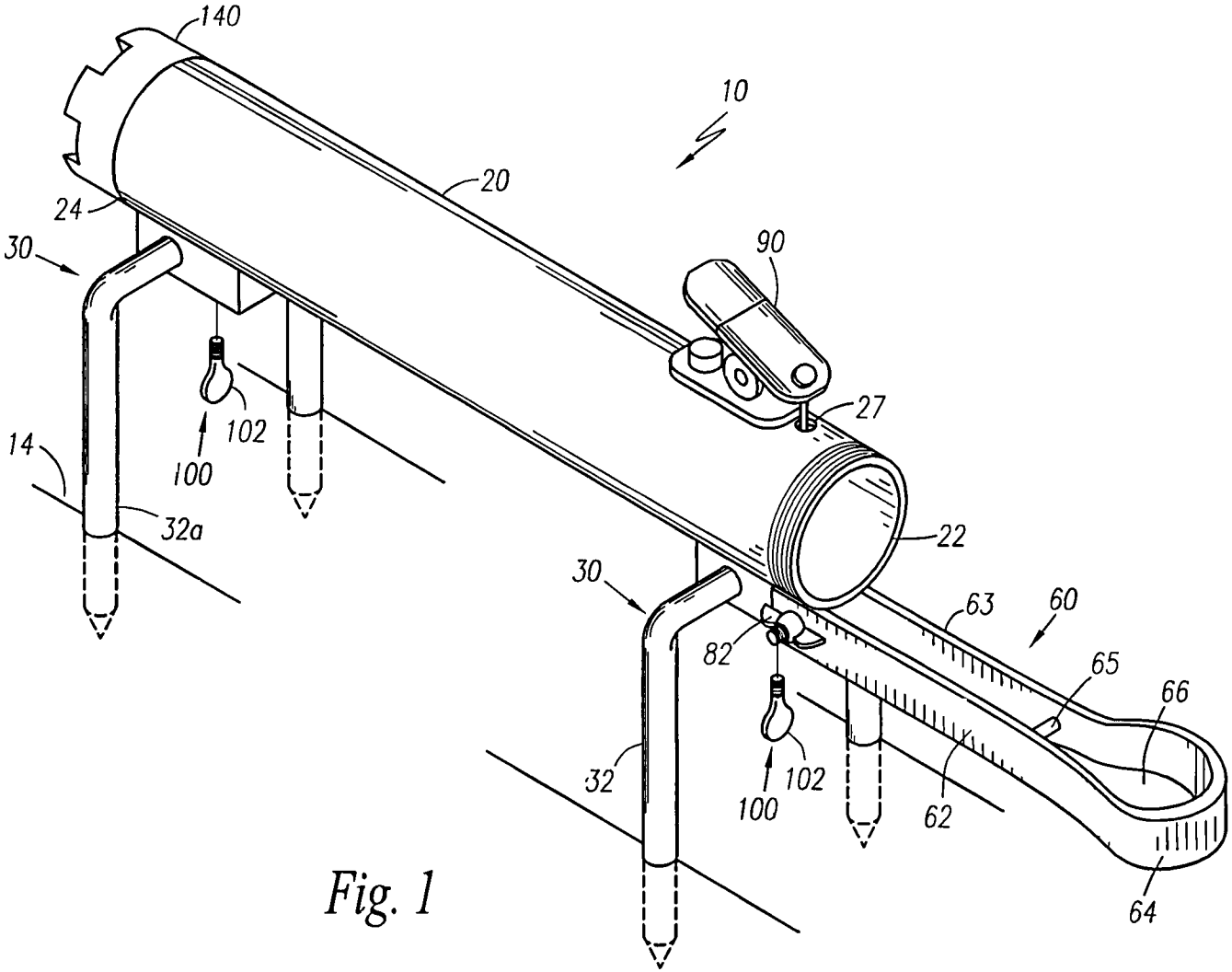
FIG. 1 is a perspective view of a golf ball dispensing and teeing device, according to one embodiment of the present invention.
Figure 2:
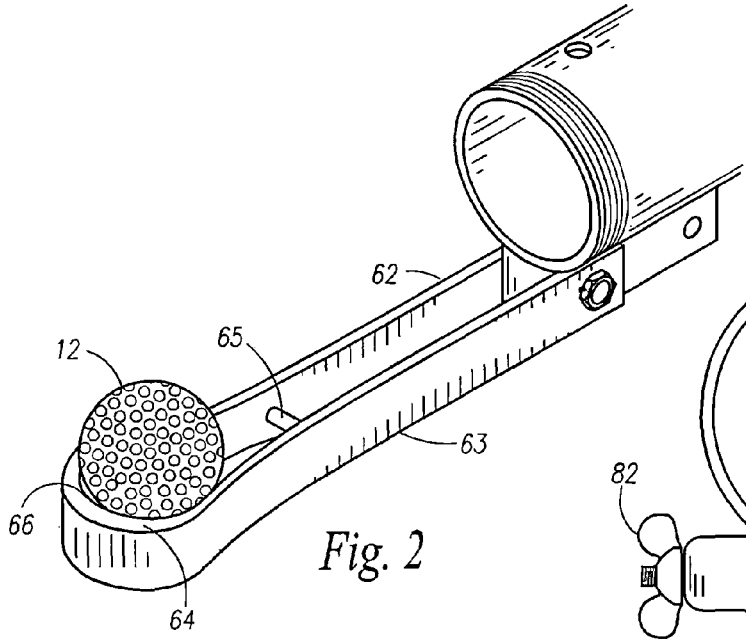
FIG. 2 is a partial side perspective view of the loading arm assembly, according to one embodiment of the present invention.
Figure 3:
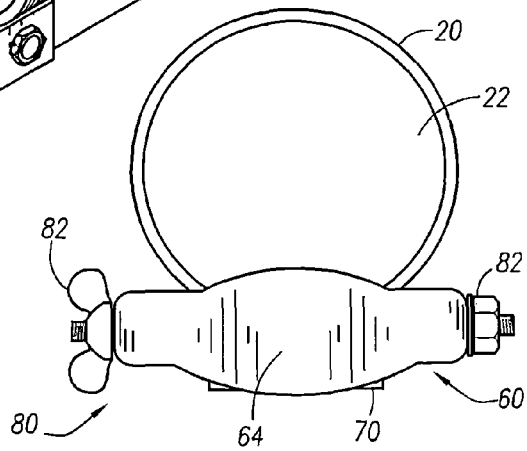
FIG. 3 is a front side elevational view of the present invention showing the loading arm assembly and locking assembly, according to one embodiment thereof.

Referring now to FIGS. 1-3, a golf ball dispensing and teeing device 10 is shown, according to the present invention, comprised of an elongated ball supply tube 20 adapted to hold a plurality of golf balls 12. The ball supply tube 20 defines an open anterior end 22 opposing an open posterior end 24 and is fabricated of a lightweight, rigid material such as plastic, plastic polymer, wood, or metal. Preferably, ball supply tube 20 is fabricated of a translucent plastic or plastic polymer material. The ball supply tube 20 is cylindrical and has an inner diameter being slightly larger than a diametrical measure of a standard golf ball 12, thereby allowing a plurality of golf balls 12 to feed into ball supply tube 20 in single file and stacked formation prior to being released onto a loading arm assembly 60, 460 (to be described later in greater detail).

The ball supply tube 20 is anchored to the ground 14 in an elevationally-declined orientation with respect thereto via an anchor mechanism 30 (to be described later in greater detail) so that golf balls 12 feed by gravity from tube 20 to a ball seat 66, 466 of the loading arm assembly 60, 460, respectively.

According to one embodiment, the loading arm assembly 60 comprises substantially parallel side rails 62 and 63 having outer ends pivotally secured via a locking assembly 80 to a front support bracket 70 (shown more clearly in FIG. 4) welded or otherwise suitably mounted to a lower, external circumferential sidewall of ball supply tube 20 proximal to the anterior end 22 thereof. Bracket 70 defines an elongated body 72 having a concave channel 74 formed along the upper surface thereof opposing a generally flat lower surface 75. The concave channel 74 is shaped so as to mount snugly against the lower, external circumferential surface of ball supply tube 20.

The parallel side rails 62 and 63 of loading arm assembly 60 are secured to bracket 70 in such a manner so as to extend outwardly from a lower plane of the anterior end 22 of ball supply tube 20 and to be elevated above the ground 14 in a declined position when the present invention is anchored to the ground 14, as illustrated in FIG. 1. An enlarged circular loop 64 forming a ball seat 66 interconnects the outer ends of the side rails 62 and 63. The enlarged circular loop 64 defines a diameter being sufficient so as to allow a standard golf ball 12 to rest immobilized thereatop. The side rails 62 are suitably spaced so as to allow a golf ball 12 to roll downwardly there along towards and into ball seat 66. A contractile member 65 is mounted perpendicularly between side rails 62 and 63 in order to hold side rails 62 and 63 in a fixed, spaced relationship. Contractile member 65 is mounted proximal to the ball seat 66. The side rails 62, 63 and enlarged circular loop 64 are fabricated of a flexible, semi-rigid material selected from the group which includes but is not limited to nylon, leather, rubber, plastic, and plastic polymer. The fabrication material is sufficiently rigid such that side rails 62, 63 maintain an elongated, rigid position while ball seat 66 supports a golf ball 12, and sufficiently flexible so as to nutate laterally upon striking the golf ball 12, after which side rails 62, 63 resume an elongated, rigid position.

Figure 1A:
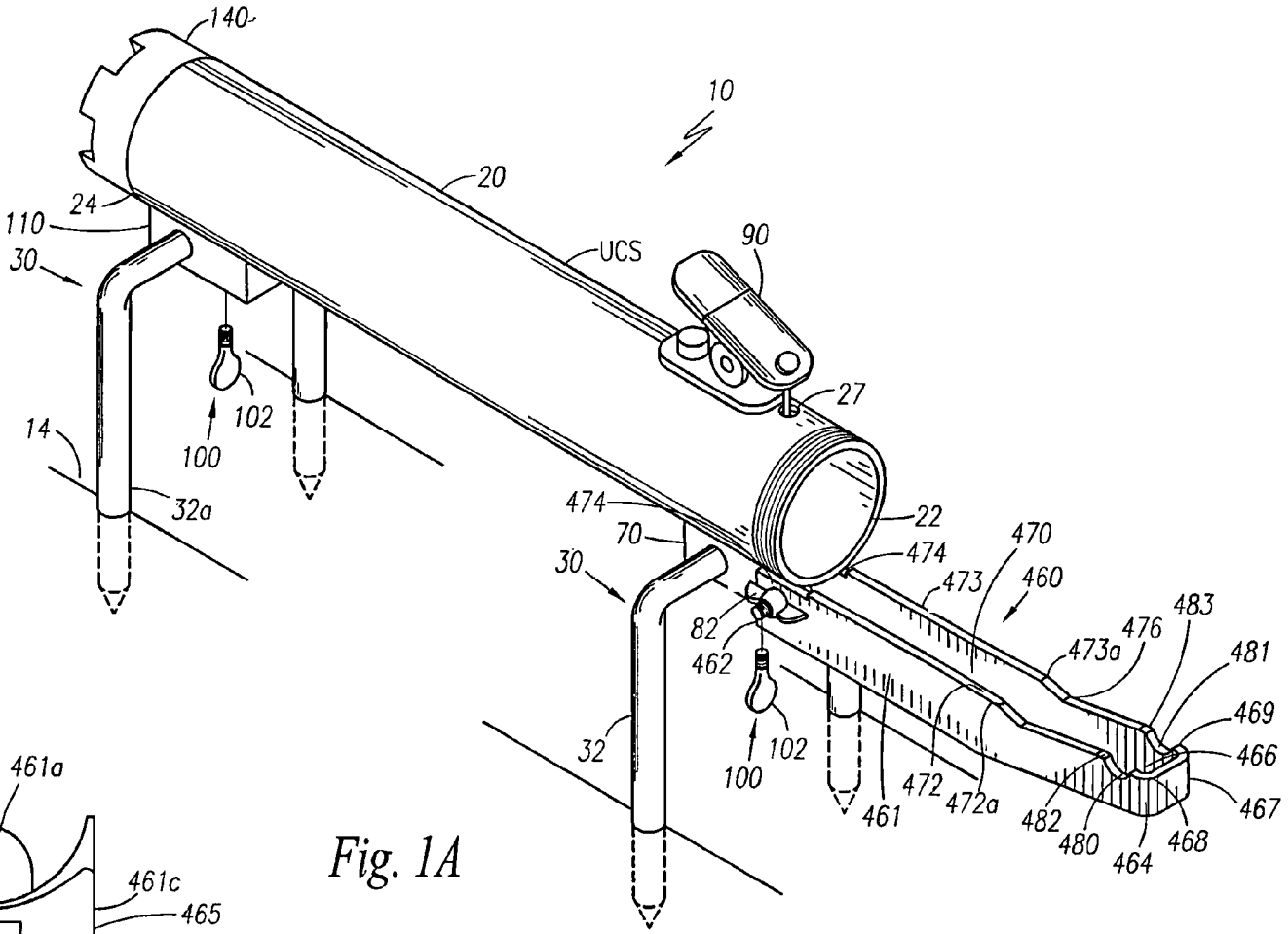
FIG. 1A is a perspective view of a golf ball dispensing and teeing device, according to the preferred embodiment of the present invention.
Figure 1B:
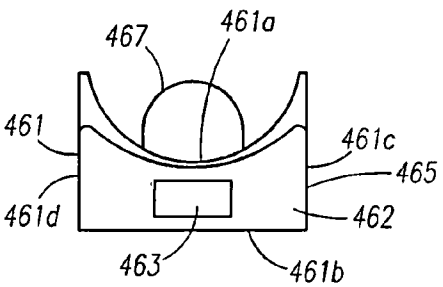
FIG. 1B is a rear elevational view of the lower end of the loading arm assembly, according to the preferred embodiment of the present invention.
Figure 4:
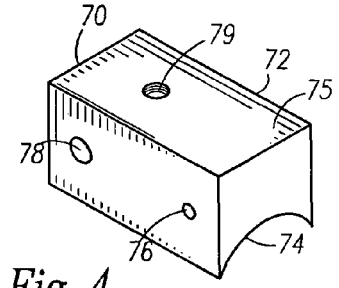
FIG. 4 is a bottom side perspective view of the front support bracket, according to the preferred embodiment.
Figure 5:
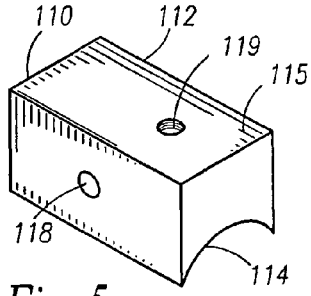
FIG. 5 is a bottom side perspective view of the rear support bracket, according to the preferred embodiment of the present invention.
Figure 6:
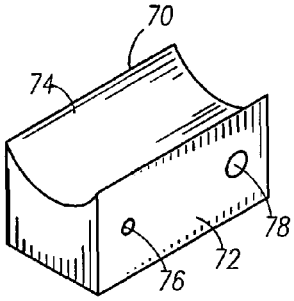
FIG. 6 is a top side perspective view of the front support bracket, according to the preferred embodiment.
Figure 7:
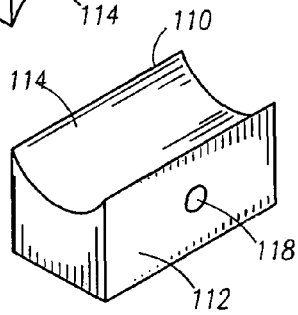
FIG. 7 is a top side perspective view of the rear support bracket, according to the preferred embodiment of the present invention.
Figure 8:
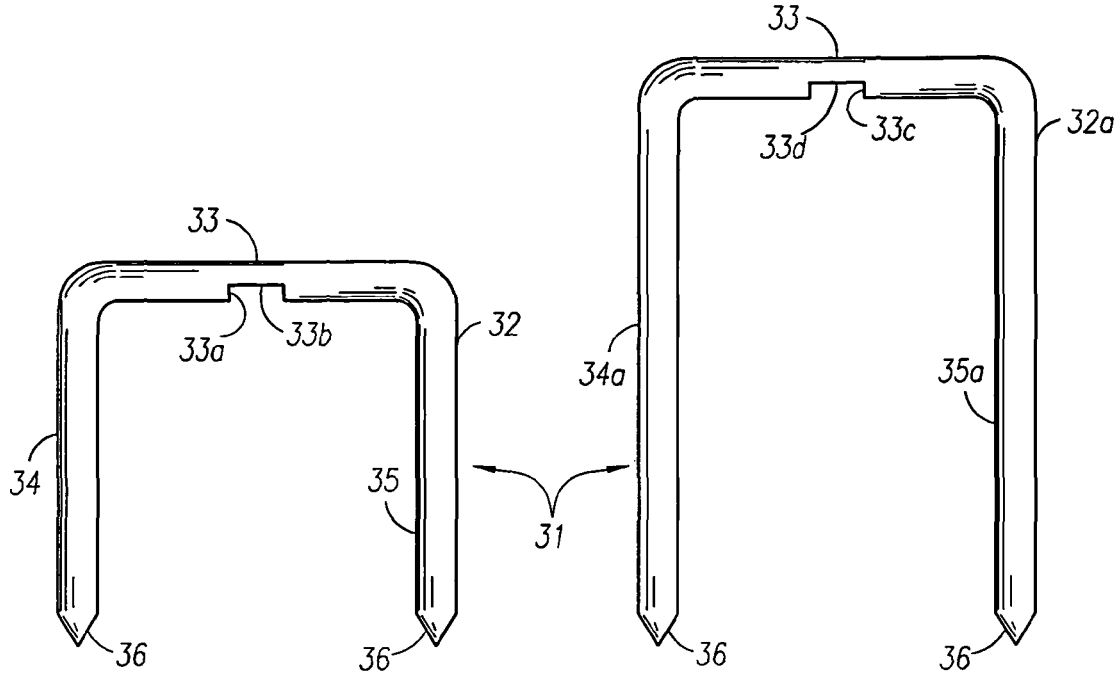
FIG. 8 is a front side elevational view of the pair of generally C-shaped members, according to the preferred embodiment of the present invention.

Referring now to FIGS. 1A, 1B, and 4, according to the preferred embodiment, the loading arm assembly 460 defines a unitary design comprising an elongated body 461, the body 461 having an upper surface 461*a*, a lower surface 461*b*, opposing sides 461*c*, 461*d*, and a lower end 462 opposing a forward end 464, the forward end 464 defining a ball seat 466. The ball seat 466 defines a diameter being sufficient so as to allow a standard golf ball 12 to rest immobilized therein. The lower end 462 includes a bracket receiving cavity 463 into which a forward end of the front support bracket 70 is inserted. The bracket receiving cavity 463 is formed between a concave channel 470 (described in greater detail hereinbelow) and the lower surface 461*b* of the elongated body 461.

The lower end 462 of the body 461 is pivotally secured via the locking assembly 80 to the front support bracket 70, the front support bracket 70 is welded or otherwise suitably mounted to a lower, external circumferential sidewall of ball supply tube 20 proximal to the anterior end 22 thereof.

The upper surface of body 461 defines a concave channel 470 formed therein and extending longitudinally theredown so as to form parallel side rails 472 and 473. The parallel side rails 472, 473, at the lower end 462 of body 461, each include an L-shaped end receiving recess 474 so as to accommodate fittingly the anterior end 22 of the ball supply tube 20.

The parallel side rails 472 and 473 of loading arm assembly 460 are secured to bracket 70 in such a manner so as to extend outwardly from a lower plane of the anterior end 22 of ball supply tube 20 and to be elevated above the ground 14 in a declined position when the present invention is anchored to the ground 14, as illustrated in FIG. 1A. Forward ends 472*a*, 473*a* of the parallel side rails 472, 473, respectively, extend downward angularly and then extend upward angularly, thereby forming a V-shaped recess 475, 476, respectively.

The ball seat 466 at the forward end 464 of the body 461 defines a raised, semi-circular incurvate wall 467 from which upper ends 468, 469 thereof each extend into a concave notch 480, 481 having an uppermost region 482, 483 which integrally interconnects with an upward inclination of the V-shaped recesses 475, 476, respectively.

The loading arm assembly 460 is fabricated preferably of a lightweight, resiliently flexible material such as a plastic polymer or an elastomer, which may be a polyolefin or a flexible polyvinyl chloride (PVC), a deformable plastic, natural rubber, synthetic rubber, polyurethane, neoprene, or a resiliently flexible thermoplastic such as vinyl or polypropylene. Alternatively, loading arm assembly 460 may be fabricated of a flexible, semi-rigid material selected from the group which includes but is not limited to nylon and leather. The selected fabrication material is sufficiently rigid such that parallel side rails 472, 473 maintain an elongated, rigid position while ball seat 466 supports a golf ball 12, and sufficiently flexible so as to nutate laterally upon striking the golf ball 12, after which parallel side rails 472, 473 resume an elongated, rigid position.

The parallel side rails 472, 473 are suitably spaced so as to allow a golf ball 12 to roll downwardly there along, while simultaneously spinning about ball's 12 central axis, towards and into the ball seat 466. Importantly, the spacing distance between the parallel side rails 472, 473 is critical for allowing the golf ball 12 to spin about its central axis while rolling down the parallel side rails 472, 473. While the ball 12 spins about it's central axis and rolls simultaneously, the spinning action by the ball 12 controls the speed at which golf ball 12 negotiates down the parallel side rails 472, 473 by decreasing the golf ball's 12 speed of descension. The speed at which the golf ball 12 travels down the parallel side rails 472, 473 is at a rate which allows the golf ball 12 to rest immobilized in the ball seat 466, and not tumble therefrom.

Referring now more specifically to FIGS. 1-4, and 6, the locking assembly 80 comprises a wingnut-bolt and washer assembly 82 adapted to pivotally secure parallel side rails 472, 473 (or side rails 62, 63) to opposed lateral sidewalls of bracket 70. As shown in FIGS. 1, 1A, and 3, one end of the wingnut-bolt and washer assembly 82 extends through a suitable aperture defined 465 through opposing sides 461*c*, 461*d* (or through side rails 62, 63) and through a suitable aperture 76 defined through the lateral sidewall of bracket 70 and is supported thereby. The wingnut-bolt and washer assembly 82 allows the ball seat 466, 66 to be vertically adjusted and fixedly positioned to a desired, suspended height above ground 14. The wingnut-bolt and washer assembly 82 further allows the ball seat 466, 66 to be vertically adjusted so as to rest atop the ground 14, in the event user so desires.

Referring now to FIGS. 1, 1A, and 4-8, the anchor mechanism 30 comprises a pair of generally C-shaped members 31, namely an anterior C-shaped member 32 and a posterior C-shaped member 32*a*, each defining a circular cross-section. Each C-shaped member 32, 32*a* defines a horizontal member 33 having opposed ends from which legs 34, 35 and 34*a*, 35*a*, respectively, extend integrally downward respectfully therefrom. Each leg 34, 35, 34*a*, 35*a* tapers into a lower pointed end 36 so as to facilitate insertion into the ground 14. Legs 34*a*, 35*a* of posterior C-shaped member 32*a* define a greater length with respect to legs 34, 35 of anterior C-shaped member 32 so as to facilitate anchoring of ball supply tube 20 in an elevationally-declined orientation with respect to the ground 14.

In order to support the ball supply tube 20 in an elevated position above ground 14, front support bracket 70 includes a circular bore 78 defined through the lateral sidewall thereof, posterior to aperture 76. The circular bore 78 is sized so as to slidably receive in a snug-fit manner anterior C-shaped member 32. More specifically, the leg 35 of anterior C-shaped member 32 is inserted through bore 78 and is extended therethrough until the horizontal member 33 portion is positioned centrally therein. The anterior C-shaped member 32 rotates in relation to ball supply tube 20, thereby allowing anterior C-shaped member 32 to be rotatably positioned rearward such that the lower pointed ends 36 of legs 34, 35 are directed toward the open posterior end 24 of ball supply tube 20, hence facilitating compact storage and transport. In order to lock anterior C-shaped member 32 such that the legs 34, 35 thereof are directed downward for insertion into the ground, front support bracket 70 is provided with an internally threaded aperture 79 defined through the lower surface 75 thereof and which extends into circular bore 78, wherein threaded aperture 79 is adapted to threadably receive a manually adjustable screw 100, such as a thumb screw 102. Thumb screw 102 is tightened until a lower end thereof engages a flat contact surface 33*b* of a recess 33*a* defined in horizontal member 33, thereby securing anterior C-shaped member 32 into a locked position. The recess 33*a* is formed centrally along the lower sidewall of horizontal member 33. Loosening of thumb screw 102 allows anterior C-shaped member 32 to freely rotate about circular bore 78.

A rear support bracket 110 is welded or suitably mounted to the lower, external circumferential sidewall of ball supply tube 20, distal to front support bracket 70. The rear support bracket 110 defines an elongated body 112 having a concave channel 114 formed along the upper surface thereof opposing a generally flat lower surface 115. The concave channel 114 is shaped so as to mount snugly against the lower, external circumferential surface of ball supply tube 20. The rear support bracket 110 includes a circular bore 118 defined through the lateral sidewall thereof. The circular bore 118 is sized so as to slidably receive in a snug-fit manner posterior C-shaped member 32*a*. More specifically, the leg 35*a* of posterior C-shaped member 32*a* is inserted through bore 118 and is extended therethrough until the horizontal member 33 portion is positioned centrally therein. The posterior C-shaped member 32*a* rotates in relation to ball supply tube 20, thereby allowing posterior C-shaped member 32*a* to be rotatably positioned forward such that the lower pointed ends 36 of legs 34*a*, 35*a* are directed toward the open anterior end 22 of ball supply tube 20, hence facilitating compact storage and transport. In this configuration, and when the lower pointed ends 36 of legs 34, 35 are directed toward the open posterior end 24 of ball supply tube 20, legs 34, 35 can be inserted within the upper opening of a golf bag (not shown) to facilitate quick, easy, and efficient transport of the present invention. In order to lock posterior C-shaped member 32*a* such that the legs 34*a*, 35*a* thereof are directed downward for insertion into the ground, rear support bracket 110 is provided with an internally threaded aperture 119 defined through the lower surface 115 thereof and which extends into circular bore 118, wherein threaded aperture 119 is adapted to threadably receive the manually adjustable screw 100, or thumb screw 102. Thumb screw 102 is tightened until a lower end thereof engages a flat contact surface 33*d* of a recess 33*c* defined in horizontal member 33, thereby securing posterior C-shaped member 32*a* into a locked position. The recess 33*c* is formed centrally along the lower sidewall of horizontal member 33. Loosening of thumb screw 102 allows posterior C-shaped member 32*a* to freely rotate about circular bore 118.

Figure 9:
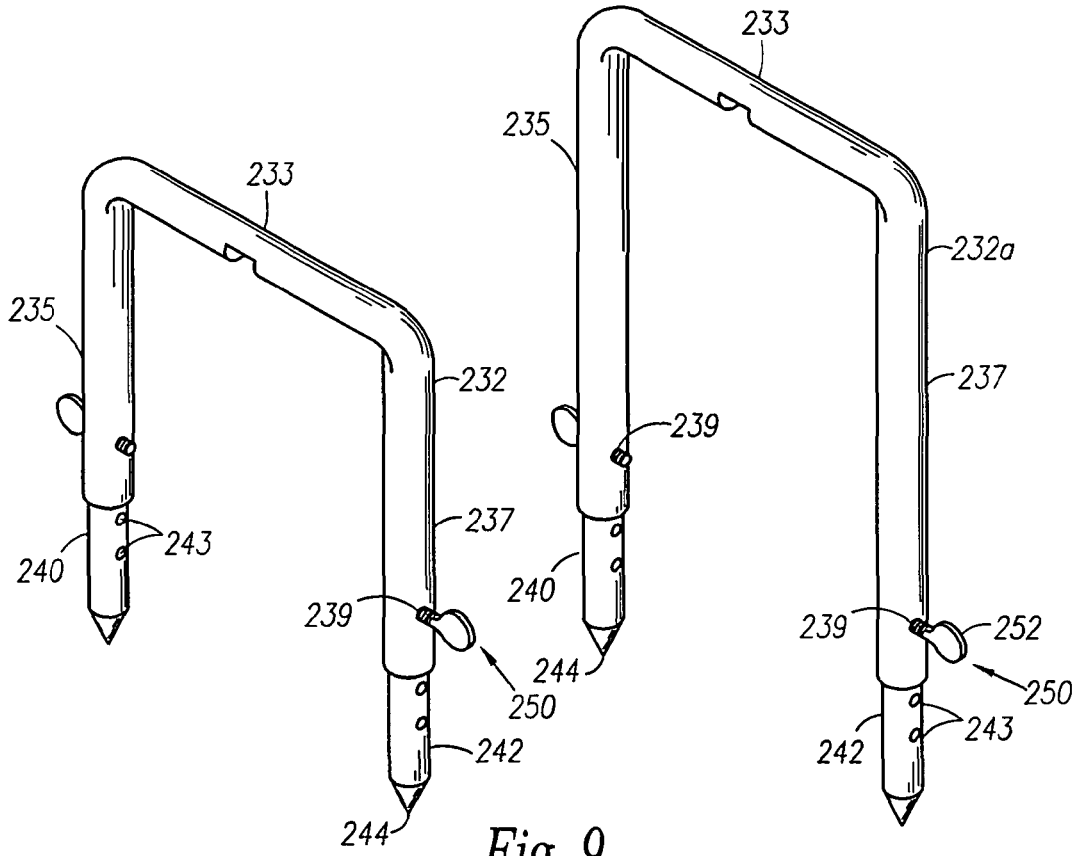
FIG. 9 is a perspective view of telescopically adjustable C-shaped members, according to one embodiment of the present invention.

Referring now to FIG. 9, it is envisioned that the pair of generally C-shaped members 31 are telescopically adjustable. In this particular embodiment, the pair of C-shaped members 31 comprises an anterior C-shaped member 232 and a posterior C-shaped member 232*a*. Each C-shaped member 232, 232*a* comprises a tubular horizontal member 233 having opposing ends from which a first tubular arm 235 and a second tubular arm 237 extend integrally downward therefrom respectfully. The first tubular arm 235 and the second tubular arm 237 are adapted to telescopically receive a first leg 240 and a second leg 242, respectively. The legs 240, 242 are adapted to be locked at a desired vertical position via a locking mechanism 250, such as a spring-biased pin assembly 252, mounted along an outer side wall of both the first tubular arm 235 and the second tubular arm 237. Each tubular arm 235, 237 includes a hole 239 defined through the outer sidewall thereof for receiving the pin 253 of spring-biased pin assembly 252. The legs 240, 242 each include a series of holes 243 defined along an outer sidewall thereof, holes 243 being adapted to receive the pin 253 of the spring-biased pin assembly 252. Thus, pin 253 is inserted through hole 239 of arm 235, 237 and extends therefrom to a selected hole 243 of leg 240, 242, thereby allowing anterior C-shaped member 232 and posterior C-shaped member 232*a* to be vertically adjustable and securable at a desired vertical position. The legs 240, 242 taper into lower pointed ends 244 so as to facilitate insertion into the ground 14.

Figure 10:
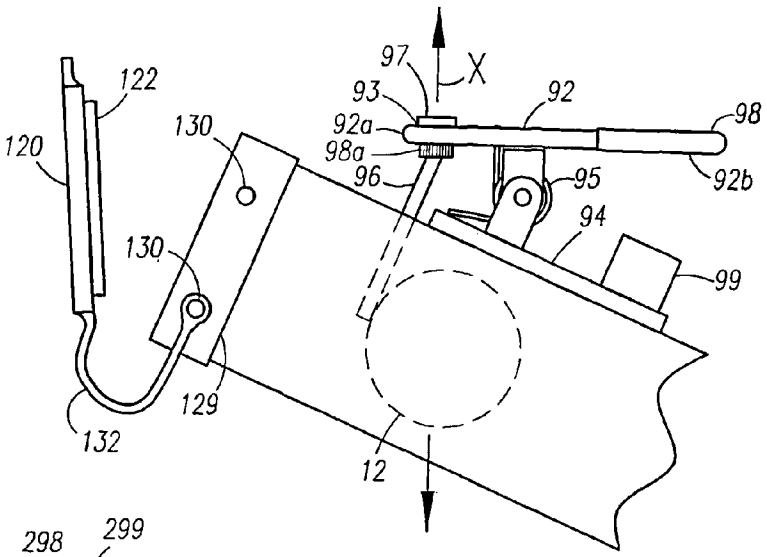
FIG. 10 is a partial side elevational view of the present invention illustrating the ball release mechanism, shown with front support bracket and loading arm assembly removed for clarity, according to the preferred embodiment.

Referring now more specifically to FIGS. 1, 1A, and 10, in order to facilitate controlled golf ball 12 release from ball supply tube 20, a ball release mechanism 90 is provided. The ball release mechanism 90 is adapted to permit a single golf ball 12 to be metered from the ball supply tube 20. The ball release mechanism 90 comprises an upper elongated jaw portion 92 hingedly attached via a spring 95 to a lower elongated jaw portion 94. The lower elongated jaw portion 94 has a bottom side welded or otherwise suitably mounted to the upper, external circumferential sidewall UCS of ball supply tube 20 proximal to the anterior end 22 thereof (the upper, external circumferential sidewall UCS of ball supply tube 20 being clearly illustrated in FIGS. 1A and 10). Upper elongated jaw portion 92 includes an anterior end 92*a* opposing a posterior end 92*b*. The anterior end 92*a* of upper elongated jaw portion 92 overhangs the lower elongated jaw portion 94 so as to allow an elongated abutment member 96 to extend downwardly through a circular opening 27 in ball supply tube 20, as will be described later in greater detail. Posterior end 92*b* includes a plastic or rubber sleeve 98 affixed therearound so as to protect the outer finish of a golf club head (not shown). Spring 95 is urged in a manner such that the anterior end 92*a* of upper elongated jaw portion 92 is biased downwardly in a resting position. This configuration allows the upper elongated jaw portion 92 to pivot between a first generally declined position (resting position) and a second generally horizontal position. The upper and lower elongated jaw portions 92, 94 are fabricated of a lightweight, rigid material such as plastic, plastic polymer, or metal.

The ball release mechanism 90 further comprises a stop member 99 which limits the second generally horizontal position of upper elongated jaw portion 92. The stop member 99 is mounted atop the lower elongated jaw portion 94, posterior to spring 95 and underneath upper elongated jaw portion 92. The stop member 99 is configured to make contact with upper elongated jaw portion 92 when upper elongated jaw portion 92 is lowered a sufficient distance.

The stop member 99 can be of any suitable configuration. In one embodiment, the stop member 99 is generally circular in a cross section and extends upwardly from the lower elongated jaw portion 94 towards the lower side of upper elongated jaw portion 92. The stop member 99 is fabricated of the same material utilized for constructing upper and lower elongated jaw portions 92, 94 or may be covered with any other suitable material in order that contact of upper elongated jaw portion 92 on stop member 99 is blunted, thereby preventing damage to upper elongated jaw portion 92 by such contact.

The elongated abutment member 96 extends downward angularly through an aperture 93 defined through the upper elongated jaw portion 92 along the anterior end 92*a* thereof. Elongated abutment member 96 may be in the form of screw 97 being secured to upper elongated jaw portion 92 via a nut and washer assembly 98*a*. Alternatively, elongated abutment member 96 may be suitably mounted to the lower surface of upper elongated jaw portion 92 along the anterior end 92*a* thereof, or formed integral thereto. Elongated abutment member 96 extends at an angle of approximately 10° through the upper elongated jaw portion 92 as measured along horizontal axis X. In a resting position, elongated abutment member 96 extends a linear distance through a circular opening 27 defined through the upper circumferential sidewall of ball supply tube 20, wherein circular opening 27 is positioned fore of lower elongated jaw portion 94. When ball release mechanism 90 is in a resting position, the elongated abutment member 96 thereof engages a first golf ball 12 of a series of golf balls 12 positioned in single file and stacked formation within ball supply tube 20, and prevents forward movement by the first golf ball 12. Elongated abutment member 96 functions as a stop to prevent a golf ball(s) 12 from dispensing from the ball supply tube 20. In order to release a single golf ball 12 through the anterior end 22 of ball supply tube 20, the posterior end 92*b* of upper elongated jaw portion 92 is depressed using the club head of a golf club (not shown), thereby concurrently urging elongated abutment member 96 upwardly against the urging of spring 95, and causing abutment member 96 to disengage from the first golf ball 12 which allows first golf ball 12 to exit the anterior end 22 of ball supply tube 20, roll slowly down the side rails 62, 63 and into ball seat 66, within which golf ball 12 resides in a resting position. In order to ensure a single golf ball 12 is metered from ball supply tube 20, the posterior end 92*b* of upper elongated jaw portion 92 is depressed and quickly released. Release of upper elongated jaw portion 92 allows spring 95 to urge elongated abutment member 96 downwardly, thereby causing abutment member 96 to engage a second golf ball 12 or golf ball 12 being next in line of the series of golf balls 12 and preventing the second golf ball 12 from dispensing from the ball supply tube 20.

In order to load golf balls 12 into the ball supply tube 20, according to the preferred embodiment, the upper elongated jaw portion 92 is pressed downwardly and held in such position as golf balls 12 are fed through the open anterior end 22 and into the hollow interior of ball supply tube 20, within which golf balls 12 are stored in single file and stacked formation.

Figure 11:
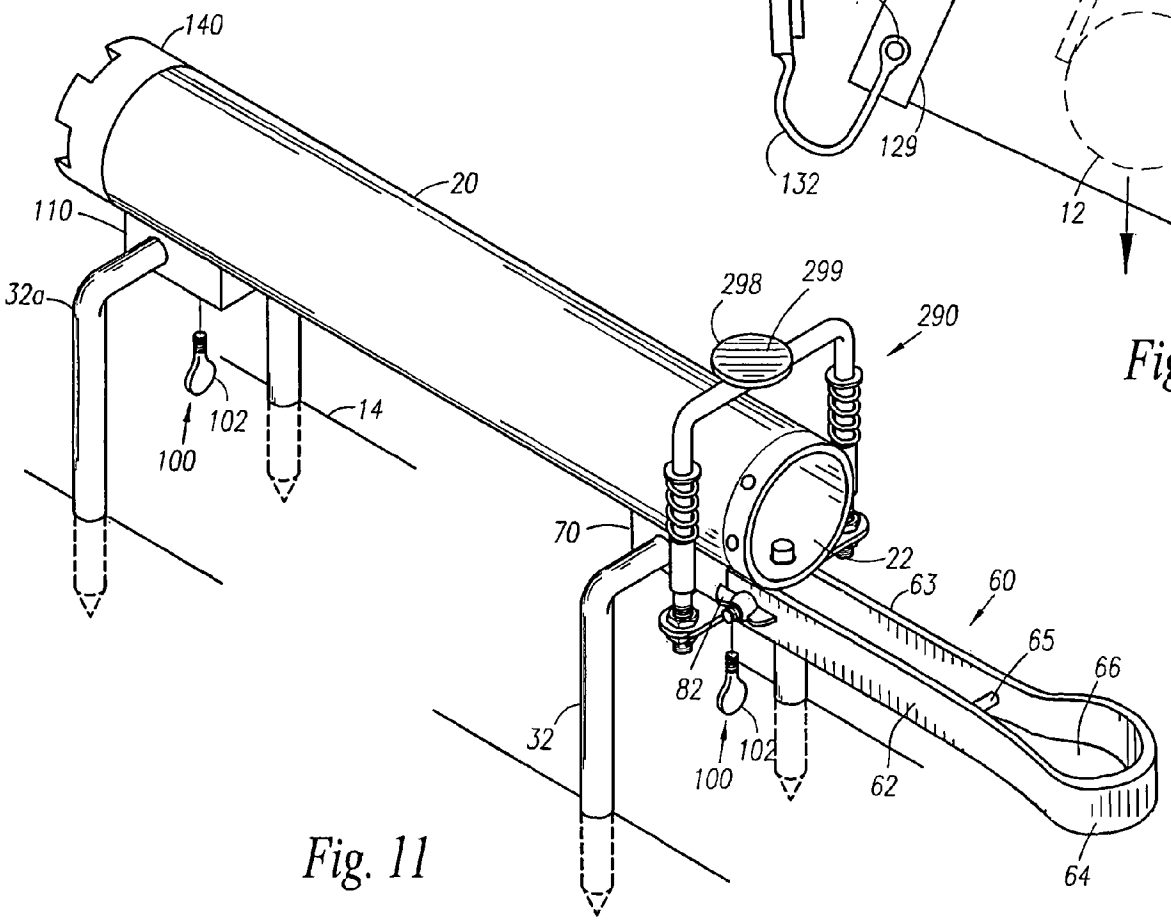
FIG. 11 is a perspective view of an alternate embodiment of the present invention.
Figure 12:
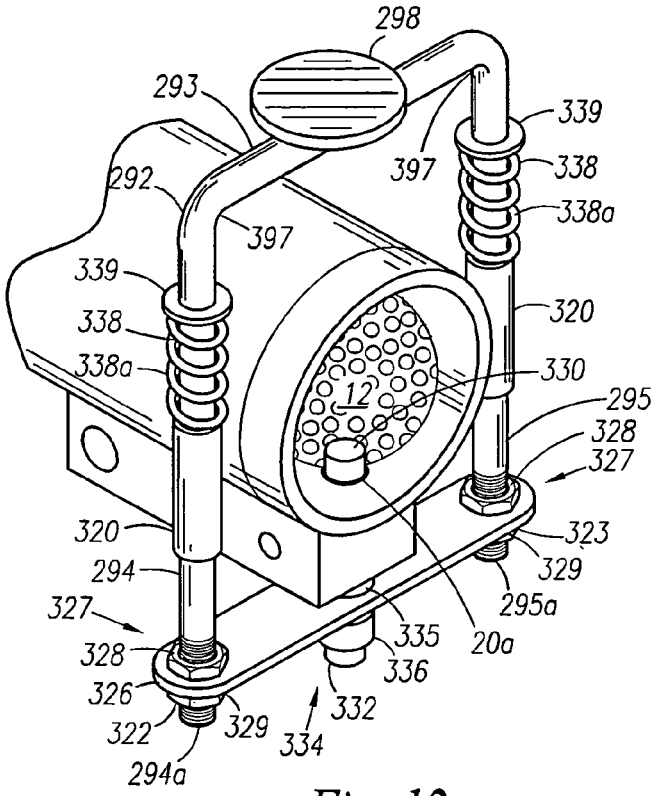
FIG. 12 is a partial front side perspective view of the alternate embodiment depicted in FIG. 11, shown with loading arm assembly removed for clarity.
Figure 13:
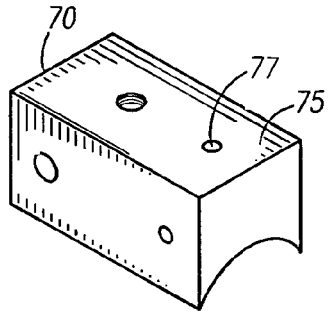
FIG. 13 is a bottom perspective view of a front support bracket adapted for use with the alternate embodiment depicted in FIGS. 11 and 12.

Referring now to FIGS. 11-13, an alternate embodiment of the present invention is provided, wherein ball release mechanism 290 comprises a U-bolt 292 defining a horizontal member 293 from which legs 294, 295 extend integrally downward from opposed ends respectfully therefrom. An upper surface of horizontal member 293 includes an oval shaped club head engaging pedal 298 welded or otherwise suitably mounted thereto. The club head engaging pedal 298 is mounted so as to be positioned in a generally flat or slightly angled orientation atop horizontal member 293. Club head engaging pedal 298 is provided with a plastic or rubber shield 299 mounted thereatop so as to protect the outer finish of a golf club head (not shown). Shield 299 defines a configuration matching club head engaging pedal 298.

The legs 294, 295 terminate into threaded ends 294*a*, 295*a*, respectively. Legs 294, 295 are inserted through respective guide cylinders 320 welded or otherwise suitably mounted in a vertical orientation along the lateral sidewalls of ball supply tube 20 at the anterior end 22 thereof. The threaded ends 294*a*, 295*a* of legs 294, 295 are inserted through apertures 322, 323, respectfully, defined through a plate 326. A pair of nuts 327 is provided for securing each of the legs 294, 295 to plate 326. The pair of nuts 327 includes an upper nut 328 threadedly engaging the threaded ends 294*a*, 295*a* above plate 326, and a lower nut 329 threadedly engaging the threaded ends 294*a*, 295*a* below plate 326. Being threadedly adjustable, the pair of nuts 327 allows for selective U-bolt 292 vertical adjustment about plate 326.

The ball release mechanism 290 further comprises an elongated abutment element 330 having a threaded lower end 332. An upper end of abutment element 330 is inserted through a suitable hole 326*a* defined centrally through plate 326 and extends through a suitable hole 77 defined through the lower surface 75 of bracket 70, and through a hole 20*a* defined through the lower external circumferential sidewall of ball supply tube 20 proximal to the anterior end 22 thereof. A pair of nuts 334 is provided for securing abutment element 330 to plate 326. The pair of nuts 334 includes an upper nut 335 threadedly engaging the threaded end 332 of abutment element 330 above plate 326, and a lower nut 336 threadedly engaging the threaded end 332 of abutment element 330 below plate 326. Being threadedly adjustable, the pair of nuts 334 allows for selective vertical adjustment by abutment element 330 about plate 326.

U-bolt 292 is biased upwardly by a spring 338 suitably disposed between an upper surface of each guide cylinder 320 and an annular flange 339 welded or otherwise suitably mounted below each bend 397 of U-bolt 292. The spring 338 is defined as a compression spring 338*a* or an open-coil helical spring constructed to oppose linear compressional forces. Alternatively, elongated abutment element 330 may be welded or otherwise suitably mounted centrally atop plate 326.

In a resting position, abutment element 330 projects upwardly from plate 326 and protrudes vertically through hole 20*a* defined through the lower external circumferential sidewall of ball supply tube 20 and engages a first golf ball 12 of a series of golf balls 12 positioned in single file and stacked formation within ball supply tube 20. Abutment element 330 functions as a stop to prevent a golf ball(s) 12 from dispensing from the ball supply tube 20. Depression of club head engaging pedal 298 concurrently urges abutment element 330 downwardly against the urging of compression spring 338*a*, thereby causing abutment element 330 to disengage from the first golf ball 12, and allowing first golf ball 12 to exit the anterior end 22 of ball supply tube 20, roll slowly down the side rails 62, 63 and into ball seat 66, within which golf ball 12 resides in a resting position. Release of the club head engaging pedal 298 allows the spring 338 to urge abutment element 330 upwardly, thereby causing abutment element 330 to engage a subsequent golf ball 12 of the series of golf balls 12 and preventing the subsequent golf ball 12 from dispensing from the ball supply tube 20. In order to ensure a single golf ball 12 is metered from ball supply tube 20, the club head engaging pedal 298 is depressed and quickly released.

Figure 14:
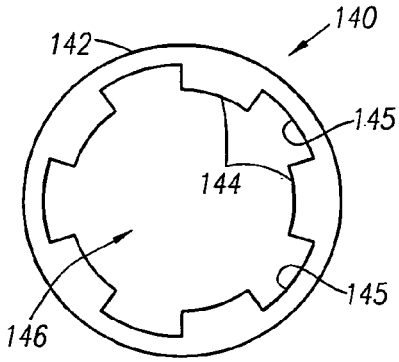
FIG. 14 is a bottom plan view of the ball retrieval mechanism, according to the preferred embodiment of the present invention.

Referring now to FIGS. 1, 1A, and 14, a ball retrieval mechanism 140 is provided, wherein ball retrieval mechanism 140 is mounted to the open posterior end 24 of ball supply tube 20. The ball retrieval mechanism 140 is fabricated of a semi-rigid, flexibly resilient material, such as plastic, plastic polymer, or rubber. Ball retrieval mechanism 140 is shown herein as comprising a collar 142 having a plurality of impingement members 144 formed integral and spaced equally along an interior circumferential sidewall thereof. The impingement members 144 are spaced by a plurality of recesses 145. The impingement members 144 collectively form a circular configuration sizably adapted to flexibly conform to a spherical configuration of golf ball 12. The collar 142 includes an annular opening 146 extending into a hollow interior of ball supply tube 20. In order to facilitate golf ball 12 retrieval, the impingement members 144 are pressed downwardly over a golf ball 12 resting on the ground 14, whereupon impingement members 144 protract outwardly to slide over and conform tightly to the spherical configuration of golf ball 12, so as to hold golf ball 12 between impingement members 144. Contact by outer end of collar 142 with the ground 14 causes golf ball 12 to slide past impingement members 144 and to release into the hollow interior of ball supply tube 20. As golf ball 12 passes impingement members 144, impingement members 144 flexibly return or contract to their natural configuration, thus preventing golf ball 12 from releasing or escaping through ball retrieval mechanism 140.

In order to load golf balls 12 into the ball supply tube 20, according to the alternate embodiment, the club head engaging pedal 298 is pressed downwardly and held in such position as golf balls 12 are fed through the open anterior end 22 and into the hollow interior of ball supply tube 20, within which golf balls 12 are stored in single file and stacked formation.

Figure 15:
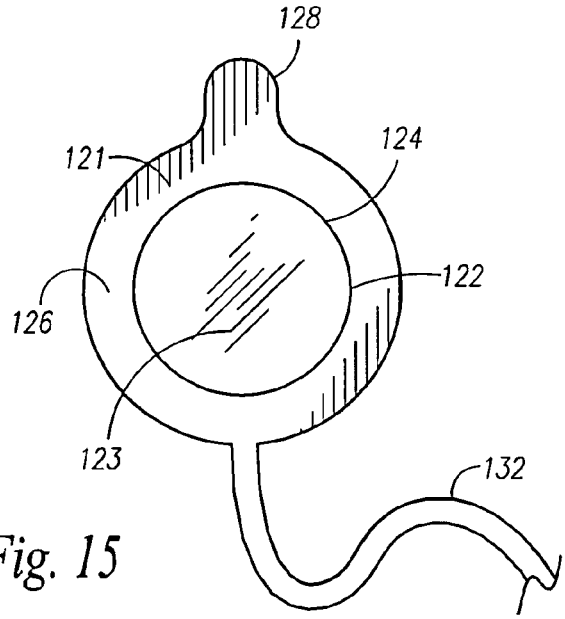
FIG. 15 is a bottom plan view of the end cap, according to the preferred embodiment of the present invention.

In reference to FIGS. 10 and 15, an end cap 120 is provided for securing a series of golf balls 12 within ball supply tube 20 so as to ensure golf balls 12 are not released therefrom due to inadvertent activation of ball release mechanism 90. The end cap 120 is fabricated of a rubber, plastic, or plastic polymer material. End cap 120 defines a generally circular configuration having a cylindrical body 122 extending integrally upward from a lower side 121 thereof. Cylindrical body 122 includes a closed top portion 123. Cylindrical body 122 and lower side 121 of end cap 120 are integrally connected at an interface 124 from which extends a peripheral edge 126. A bulbous tab 128 extends integrally outward from the peripheral edge 126. In order to removably secure end cap 120 to the open anterior end 22 of ball supply tube 20, an annular collar 129 is affixed to the open anterior end 22 of ball supply tube 20 via a plurality of fasteners 130. The cylindrical body 122 of end cap 120 is adapted to mate with annular collar 129. More specifically, end cap 120 engages annular collar 129 in a manner such that the external circumferential sidewall of cylindrical body 122 intimately mates with an inner circumferential sidewall of annular collar 120. Cylindrical body 122 and annular collar 129 have a snug-fit relationship. End cap 120 is urged forward until an outer end of annular collar 129 contacts an upper surface of the peripheral edge 126 of end cap 120, thus removably securing end cap 120 to annular collar 129 via frictional or mechanical interference. The bulbous tab 128 provides a gripping means to facilitate easy manual removal of end cap 120 from annular collar 129.

An elongated tether 132 is provided which extends integrally from the peripheral edge 126 of end cap 120, opposing bulbous tab 128. An outer end of elongated tether 132 is fastened to the external circumferential sidewall of annular collar 129 via a fastener 130.

Figure 16:
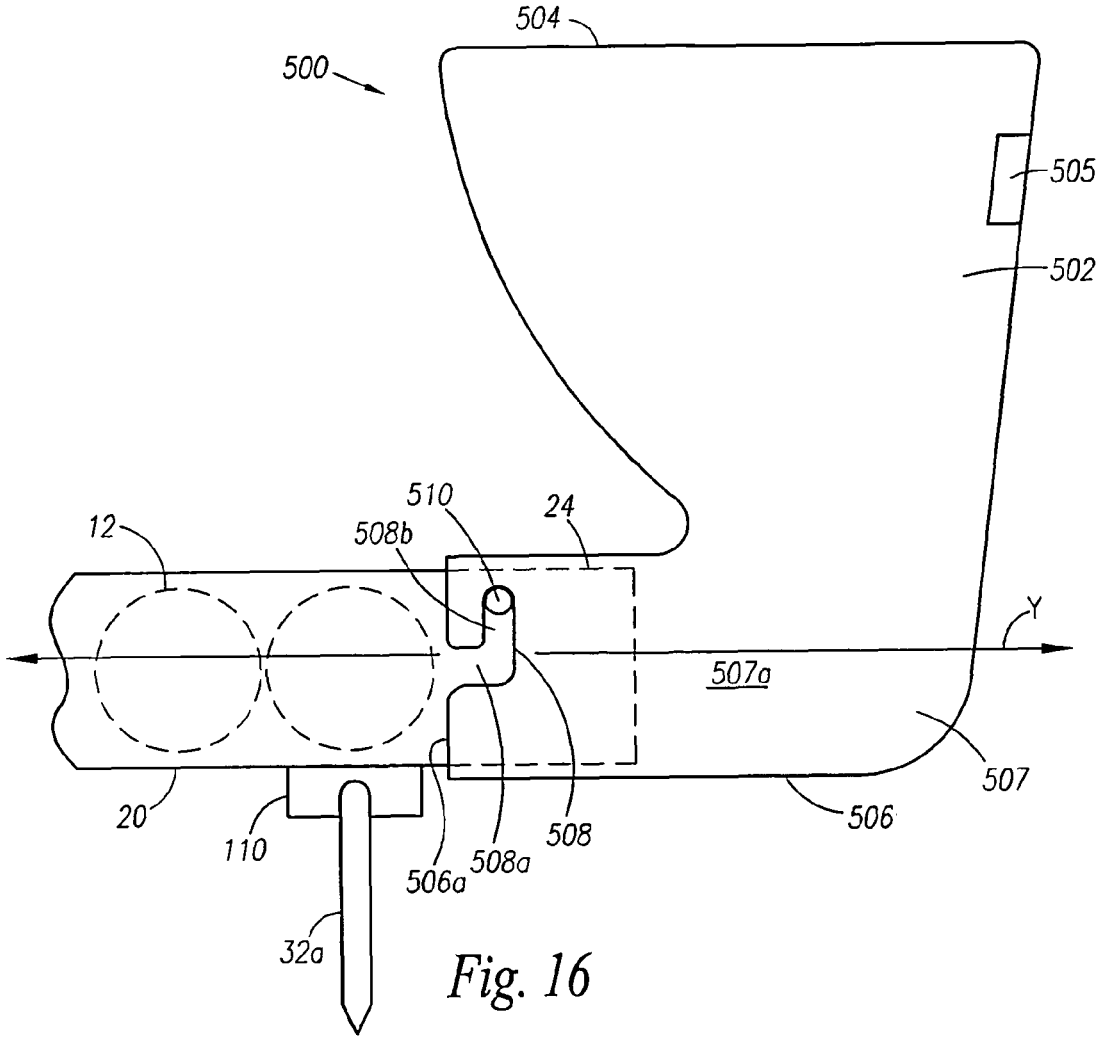
FIG. 16 is partial side elevational view of a hopper shown releasably locked to the posterior end of the ball supply tube of the present invention, according to the preferred embodiment thereof.

Referring to FIG. 16, a hopper 500 is provided for holding a supply of golf balls 12. The hopper 500 defines a hollow body 502 having an open top 504 and a lower discharge outlet 506. The open top 504 provides direct passage into a chamber 505 which is in fluid communication with the lower discharge outlet 506. The body 502 of hopper tapers downward from the open top 504 to the lower discharge outlet 506. The lower discharge outlet 506 is defined as an incurvate elbow 507 having a mouth portion 506*a* and an L-shaped slot 508 defined through a sidewall 507*a* thereof. The L-shaped slot 508 initiates at the mouth portion 506*a* of lower discharge outlet 506, and wherein the L-shaped slot 508 defines a horizontal void portion 508*a* and a vertical void portion 508*b*. The slot 508 is adapted to slidably receive a cylindrical, protruding boss 510 welded or otherwise suitably mounted to the external circumferential sidewall of the ball supply tube 20 proximal to the posterior end 24 thereof, above axis Y.

The mouth portion 506*a* of the discharge outlet 506 slidably engages intimately the posterior end 24 of the ball supply tube 20 in a snug fit manner. The hopper 500 is rotated in a direction allowing the boss 510 to align with and slidably engage the horizontal void portion 508*a* of the slot 508, whereupon hopper 500 is rotated counter-clockwise to negotiate boss 510 within the vertical void portion 508*b* of slot 508, thereby releasably locking hopper 500 onto the posterior end 24 of the ball supply tube 20. The slot 508 is formed in the discharge outlet 506 in a fashion such that when the boss 510 engages the vertical void portion 508*b* of slot 508, the open top 504 of hopper 500 is positioned upwardly.

In order to release the hopper 500 from the posterior end 24 of ball supply tube 20, the aforementioned steps are repeated in a reverse sequential order.

Figure 17:
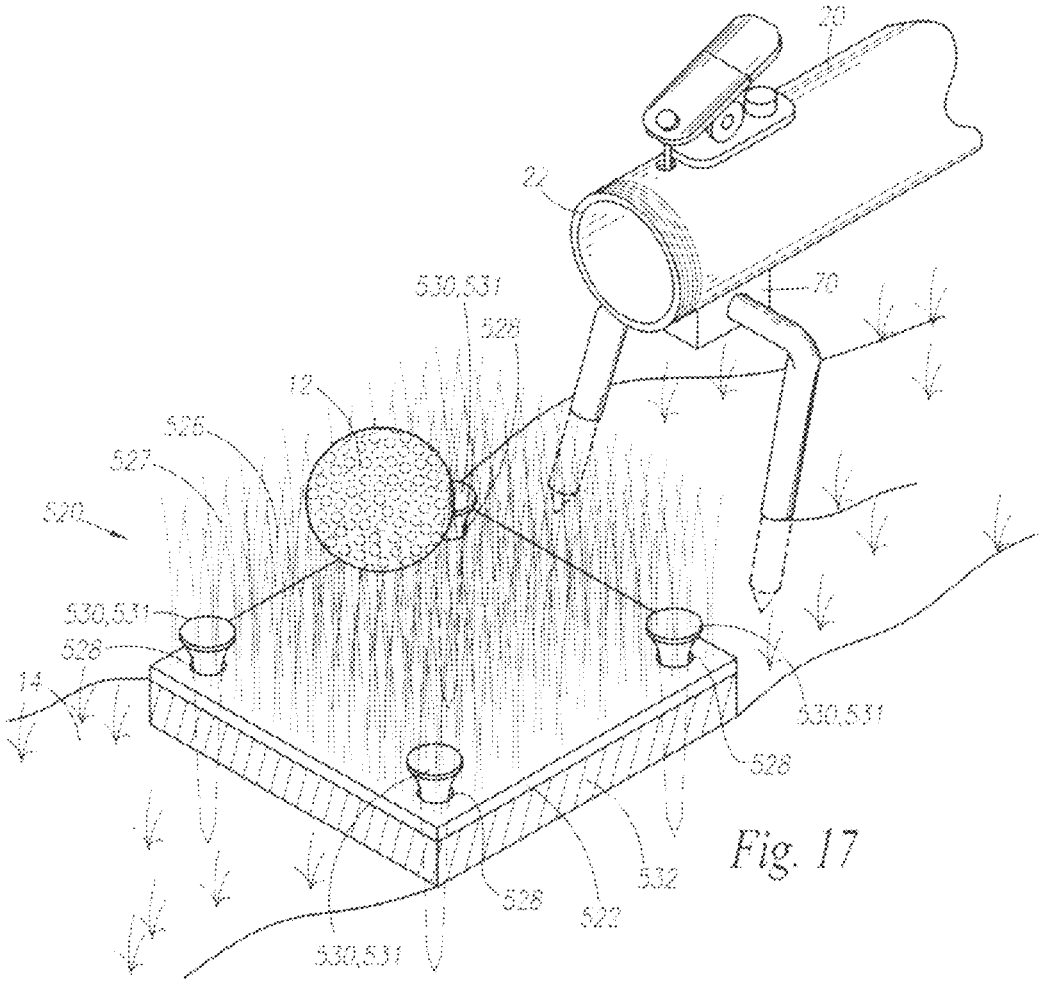
FIG. 17 is a partial side perspective view of the ball supply tube illustrating a golf ball tee apparatus placed frontal thereto, according to another embodiment of the present invention.
Figure 18:
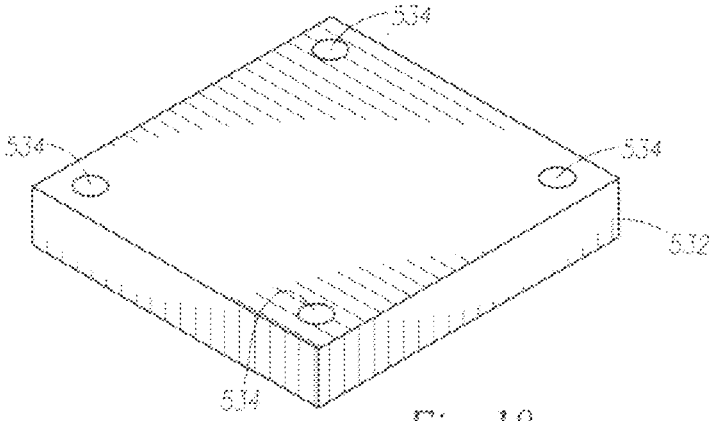
FIG. 18 is perspective view of a platform of the golf ball tee apparatus of FIG. 17.

Finally, referring now to FIGS. 17 and 18, an alternate embodiment of the present invention is provided, wherein a golf ball tee apparatus 520 is disclosed. The tee apparatus 520 may be used, in lieu of either loading arm assembly 60, 460, as an alternative means for supporting a golf ball 12 prior to being struck by the club head of a golf club. The tee apparatus 520 is aligned juxtaposed to the anterior end 22 of the ball supply tube 20 so as to be aligned facially therewith.

The tee apparatus 520 comprises a base 522 having an upper surface densely populated with flexible, fibrous bristles 526 of suitable rigidity so as to extend upright in a vertical direction. The fibrous bristles 526, being densely populated, form a bed 527 of fibrous bristles 526 having a bristle surface 528. Because the fibrous bristles 526 are dense and suitably rigid, the bristle surface 528 supports a golf ball 12, thus, the bristle surface 528 forms a hitting surface for striking golf balls 12. More specifically, the bristle surface 528 supports and catches the golf ball 12 such that the golf ball 12 seats in a fixed position atop the bristle surface 528 after the golf ball 12 exits the anterior end 22 of the ball supply tube 20.

The fibrous bristles 526 are constructed of a material such that the frictional heating caused by the swinging club head of a golf club will not melt the material leaving residue on the club head and causing excessive wear and deterioration. The fibrous bristles 526 are envisioned to be constructed of a polymer material, such as nylon.

The tee apparatus 520 is designed and configured such that as the golf ball 12 rolls through the ball supply tube 20 and exits the anterior end 22 thereof, the golf ball 12 comes to rest atop the bristle surface 528.

In order to anchor the golf ball tee apparatus 520 to the ground 14, the base 522 includes a plurality of holes 528 defined through corners thereof, through which anchor means 530 are inserted respectively therethrough and into the ground 14. The anchor means 530 is shown herein as golf tees 531.

In order to elevate the golf ball tee apparatus 520, at least one platform 532 having an equal area (length×width) as base 522, is placed and aligned against a lower surface of the base 522. Platform 532 defines a greater height than a height of base 522. The platform 532 is provided with holes 534 which align with holes 528 in base 522 when base 522 and platform 532 are engaged in a stacked configuration, as shown in FIG. 17. Golf tees 530 are inserted through the plurality of holes 528 in the base 522 and through the holes 534 in the platform 532 and into the ground 14.

2. Operation of the Preferred Embodiment

To use the present invention, user depresses the upper elongated jaw portion 92 of the ball release mechanism 90 and holds the jaw portion 92 in such downward position in order to feed golf balls 12 through the open anterior end 22 and into the hollow interior of ball supply tube 20, within which the golf balls 12 are stored in single file and in stacked formation. Once the ball supply tube 20 is filled with a desired number of golf balls 12, user releases the upper elongated jaw portion 92, thereby preventing golf balls 12 from dispensing from the ball supply tube 20. User next rotates the anterior and posterior C-shaped members 32 and 32*a* in a manner whereby the legs 34, 35 and 34*a*, 35*a*, respectively thereof are directed downward for insertion into the ground 14. To lock the C-shaped members 32 and 32*a* in a downward position, user tightens thumb screw 102 within threaded aperture 79 and 119, respectively. User then inserts C-shaped members 32 and 32*a* into the ground 14 in such a manner that the present invention is positioned in an elevationally-declined orientation with respect to the ground 14. The posterior end 24 of ball supply tube 20 is positioned so as to be oriented at a higher elevation than the anterior end 22 of ball supply tube 20, thereby allowing golf balls 12 to feed by gravity from tube 20 to the ball seat 466 of the loading arm assembly 460. Finally, user depresses the posterior end 92*b* of the upper elongated jaw portion 92 of the ball release mechanism 90 using the club head of a golf club, thereby concurrently urging the elongated abutment member 96 upwardly against the urging of spring 95, and causing abutment member 96 to disengage from the first golf ball 12 which allows the first golf ball 12 to exit the anterior end 22 of ball supply tube 20, roll slowly down the parallel side rails 472, 473 and into ball seat 466, within which golf ball 12 resides in a resting position. In order to ensure a single golf ball 12 is metered from ball supply tube 20, the posterior end 92*b* of upper elongated jaw portion 92 is depressed and quickly released. User then drives the golf ball 12 off of ball seat 466 or tee. User actuates the ball release mechanism 90 each time user desires to drive a golf ball 12 from ball seat 466.

The use of the present invention allows a single golf ball to be metered from a supply tube and travel therefrom to rest atop an elevated ball seat in a manner which is quick, easy, and efficient.

It is envisioned that the various embodiments, as separately disclosed, are interchangeable in various aspects, so that elements of one embodiment may be incorporated into one or more of the other embodiments, and that specific positioning of individual elements may necessitate other arrangements not specifically disclosed to accommodate performance requirements or spatial considerations.

It is to be understood that the embodiments and claims are not limited in its application to the details of construction and arrangement of the components set forth in the description and illustrated in the drawings. Rather, the description and the drawings provide examples of the embodiments envisioned, but the claims are limited to the specific embodiments. The embodiments and claims disclosed herein are further capable of other embodiments and of being practiced and, carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the U.S. Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A golf ball dispensing and teeing device comprising:

an elongated ball supply tube, the ball supply tube is adapted to hold a plurality of golf balls, the ball supply tube defines an open anterior end opposing an open posterior end, the ball supply tube is cylindrical and has an inner diameter being slightly larger than a diametrical measure of a golf ball;

an anchor mechanism, the anchor mechanism anchors the ball supply tube to a ground in an elevationally-declined orientation with respect to the ground;

a loading arm assembly, the loading arm assembly receives a plurality of golf balls from the ball supply tube via gravity feed, the loading arm assembly is pivotally secured to the anchor mechanism via a locking assembly, the loading arm assembly defines a unitary design, the loading arm assembly comprising an elongated body, the elongated body having an upper surface, a lower surface, opposing sides, and a lower end opposing a forward end, the forward end defining a ball seat, wherein the lower end of the elongated body includes a bracket receiving cavity into which a forward end of the front support bracket of the anchor mechanism is inserted, the lower end of the elongated body is pivotally secured to the front support bracket via the locking assembly, the upper surface of the elongated body defines a concave channel formed therein and extending longitudinally theredown so as to form parallel side rails, the bracket receiving cavity is formed between the concave channel and the lower surface of the elongated body, the parallel side rails, at the lower end of the elongated body, each include an L-shaped end receiving recess so as to accommodate fittingly the anterior end of the ball supply tube, the parallel side rails of the loading arm assembly are secured to the front support bracket in such a manner so as to extend outwardly from a lower plane of the anterior end of the ball supply tube and to be elevated above the ground in a declined position when the present invention is anchored to the ground, the parallel side rails each having a forward end extending downward angularly and then extending upward angularly, thereby forming a V-shaped recess, and wherein the ball seat at the forward end of the elongated body defines a raised, semi-circular incurvate wall from which upper ends thereof each extend into a concave notch, each the concave notch having an uppermost region which integrally interconnects with an upward inclination of each the V-shaped recess, respectively; and a ball release mechanism, the ball release mechanism permits a single golf ball to be metered from the ball supply tube, the ball release mechanism is welded or otherwise suitably mounted to an upper, external circumferential sidewall of the ball supply tube proximal to the open anterior end thereof.

2. The golf ball dispensing and teeing device of claim 1, wherein the locking assembly comprises a wingnut-bolt and washer assembly adapted to pivotally secure the parallel side rails to an opposed lateral sidewalls of the front support bracket, wherein one end of the wingnut-bolt and washer assembly extends through a first suitable aperture defined through the opposing sides of the elongated body and through a second suitable aperture defined through the opposed lateral sidewalls of the front support bracket and is supported thereby, the second suitable aperture positioned anterior to a circular bore defined through the opposed lateral sidewalls of the front support bracket, the wingnut-bolt and washer assembly allows the ball seat to be pivotally adjusted vertically and fixedly positioned to a desired, suspended height above the ground.

3. The golf ball dispensing and teeing device of claim 1, wherein the loading arm assembly is constructed of a lightweight, resiliently flexible material, the material is sufficiently rigid such that the parallel side rails maintain an elongated, rigid position while the ball seat supports a golf ball, and sufficiently flexible so as to nutate laterally upon striking the golf ball, after which the parallel side rails resume an elongated, rigid position.

4. The golf ball dispensing and teeing device of claim 1, wherein the parallel side rails are suitably spaced so as to allow a golf ball to roll downwardly there along, while the golf ball simultaneously spins about the golf ball's central axis, towards and into the ball seat.

5. The golf ball dispensing and teeing device of claim 1, wherein the ball release mechanism comprises an upper elongated jaw portion hingedly attached via a spring to a lower elongated jaw portion, the lower elongated jaw portion has a bottom side welded or otherwise suitably mounted to the upper, external circumferential sidewall of the ball supply tube proximal to the open anterior end thereof, the upper elongated jaw portion includes an anterior end opposing a posterior end, wherein the anterior end of the upper elongated jaw portion overhangs the lower elongated jaw portion, the posterior end of the upper elongated jaw portion includes a sleeve affixed therearound so as to protect an outer finish of a golf club head, the sleeve being constructed of a plastic or rubber material.

6. The golf ball dispensing and teeing device of claim 5, wherein the spring is urged in a manner such that the anterior end of the upper elongated jaw portion is biased downwardly in a resting position, thereby allowing the upper elongated jaw portion to pivot between a first generally declined position and a second generally horizontal position.

7. The golf ball dispensing and teeing device of claim 5, wherein the ball release mechanism further comprises:

a stop member, the stop member limits the second generally horizontal position of the upper elongated jaw portion, the stop member is mounted atop the lower elongated jaw portion, posterior to the spring and underneath the upper elongated jaw portion, the stop member makes contact with the upper elongated jaw portion when the upper elongated jaw portion is lowered a sufficient distance; and an elongated abutment member, the abutment member extends downward angularly from the upper elongated jaw portion along the anterior end thereof, the abutment member extends from the upper elongated jaw portion at an angle of approximately 10°, wherein the abutment member extends a linear distance through a circular opening defined through the upper, external circumferential sidewall of the ball supply tube when the ball release mechanism is in a resting position, the circular opening is positioned fore of the lower elongated jaw portion, and wherein the abutment member engages a first golf ball of a series of golf balls positioned in single file and stacked formation within the ball supply tube, thereby preventing forward movement by the first golf ball when the ball release mechanism is in a resting position, the elongated abutment member functions as a stop to prevent the golf ball(s) from dispensing from the ball supply tube, and to facilitate release of a single golf ball through the open anterior end of the ball supply tube, the posterior end of the upper elongated jaw portion is depressed and quickly released, wherein depression of the posterior end of the upper elongated jaw portion concurrently urges the abutment member upwardly against an urging of the spring, and causing the abutment member to disengage from the first golf ball which allows the first golf ball to exit the open anterior end of the ball supply tube, roll slowly and simultaneously spin about its central axis down the parallel side rails and into the ball seat, within which the first golf ball resides in a resting position, and wherein release of the upper elongated jaw portion allows the spring to urge the abutment member downwardly, thereby causing the abutment member to engage a subsequent golf ball of the series of golf balls and preventing the subsequent golf ball from dispensing from the ball supply tube.

8. The golf ball dispensing and teeing device of claim 1, further comprising:

a hopper for holding a supply of golf balls, the hopper defines a hollow body having an open top and a lower discharge outlet, the open top provides direct passage into a chamber being in fluid communication with the lower discharge outlet, the body of the hopper tapers downward from the open top to the lower discharge outlet, the lower discharge outlet is defined as an incurvate elbow having a mouth portion and an L-shaped slot defined through a sidewall of the incurvate elbow, the L-shaped slot initiates at the mouth portion of the lower discharge outlet, and wherein the L-shaped slot defines a horizontal void portion and a vertical void portion, the L-shaped slot slidably receives a cylindrical, protruding boss suitably mounted to the external circumferential sidewall of the ball supply tube proximal to the posterior end thereof.

9. The golf ball dispensing and teeing device of claim 8, wherein the mouth portion of the discharge outlet slidably engages intimately the posterior end of the ball supply tube in a snug fit manner, the hopper is rotated in a direction allowing the boss to align with and slidably engage the horizontal void portion of the L-shaped slot, whereupon the hopper is rotated counter-clockwise to negotiate boss within the vertical void portion of the L-shaped slot, thereby releasably locking the hopper onto the posterior end of the ball supply tube, and wherein the L-shaped slot is formed in the discharge outlet in a fashion such that when the boss engages the vertical void portion, the open top of the hopper is positioned upwardly.

10. The golf ball dispensing and teeing device of claim 1, further comprising:

a ball retrieval mechanism, the ball retrieval mechanism is mounted to the posterior end of the ball supply tube, the ball retrieval mechanism is adapted for picking up golf balls one at a time, the ball retrieval mechanism comprises a collar having a plurality of impingement members formed integral and spaced equally along an interior circumferential sidewall of the collar, the impingement members are spaced by a plurality of recesses, the impingement members collectively form a circular configuration sizably adapted to flexibly conform to a spherical configuration of a golf ball, the collar includes an annular opening extending into a hollow interior of the ball supply tube, the impingement members are pressed downwardly over a golf ball resting on the ground, whereupon the impingement members protract outwardly to slide over and conform tightly to a spherical configuration of the golf ball, so as to hold the golf ball between the impingement members, and an outer end of the collar contacts the ground causing the golf ball to slide past the impingement members and to release into a hollow interior of the ball supply tube, whereupon the impingement members flexibly return or contract to their natural configuration, thus preventing the golf ball from releasing or escaping through the ball retrieval mechanism;

an annular collar affixed to the anterior end of the ball supply tube via a plurality of fasteners;

an end cap, the end cap is removably securable to the anterior end of the ball supply tube, the end cap is adapted for securing a series of golf balls within the ball supply tube, the end cap defines a generally circular configuration having a cylindrical body extending integrally upward from a lower side of the end cap, the cylindrical body includes a closed top portion, the cylindrical body and the lower side of the end cap are integrally connected at an interface from which extends a peripheral edge, the peripheral edge has a bulbous tab extending integrally outward therefrom the peripheral edge, the cylindrical body engages the annular collar in a manner such that an external circumferential sidewall of the cylindrical body intimately engages an inner circumferential sidewall of the annular collar forming a snug fit relationship therebetween, the end cap is urged forward until an outer end of the annular collar contacts an upper surface of the peripheral edge of the end cap, thereby removably securing the end cap to the annular collar via frictional or mechanical interference; and an elongated tether extending integrally from the peripheral edge of the end cap, opposing the bulbous tab, the tether having an outer end fastened to an external circumferential sidewall of the annular collar via a fastener.

11. The golf ball dispensing and teeing device of claim 1, wherein the ball supply tube is fabricated of a lightweight, rigid material.

12. The golf ball dispensing and teeing device of claim 1, wherein the anchor mechanism comprises:

a front support bracket welded or otherwise suitably mounted to a lower, external circumferential sidewall of the ball supply tube proximal to the open anterior end thereof, the front support bracket defines an elongated body having a concave channel formed along an upper surface thereof, the front support bracket includes opposed lateral sidewalls, the upper surface of the front support bracket opposes a generally flat lower surface, the concave channel of the front support bracket is shaped so as to mount snugly against a lower, external circumferential surface of the ball supply tube, the front support bracket includes a circular bore defined through the opposed lateral sidewalls thereof; and a rear support bracket welded or suitably mounted to the lower, external circumferential sidewall of the ball supply tube, distal to the front support bracket, wherein the rear support bracket defines an elongated body having a concave channel formed along an upper surface thereof, the upper surface of the rear support bracket opposing a generally flat lower surface, the concave channel of the rear support bracket is shaped so as to mount snugly against the lower, external circumferential surface of the ball supply tube, and wherein the rear support bracket includes a circular bore defined through a lateral sidewall thereof.

13. The golf ball dispensing and teeing device of claim 1, wherein the ball seat defines a diameter being sufficient so as to allow a standard golf ball to rest immobilized therein.

14. The golf ball dispensing and teeing device of claim 12, wherein the anchor mechanism further comprises an anterior C-shaped member and a posterior C-shaped member, the anterior C-shaped member and the posterior C-shaped member each defining a circular cross-section, the anterior C-shaped member and the posterior C-shaped member each defining a horizontal member having opposed ends from which legs extend integrally downward respectfully therefrom, each of the legs taper into a lower pointed end so as to facilitate insertion into the ground, wherein the legs of the posterior C-shaped member define a greater length with respect to the legs of the anterior C-shaped member, thereby facilitating anchoring of the ball supply tube in an elevationally-declined orientation with respect to the ground, and wherein the circular bore of the rear support bracket is sized so as to slidably receive in a snug-fit manner the posterior C-shaped member, the leg of the posterior C-shaped member is inserted through the circular bore of the rear support bracket and is extended therethrough until the horizontal member of the posterior C-shaped member is positioned centrally inside the circular bore of the rear support bracket, the posterior C-shaped member rotates in relation to the ball supply tube, thereby allowing the posterior C-shaped member to be rotatably positioned forward in order to facilitate compact storage and transport.

15. The golf ball dispensing and teeing device of claim 14, wherein the rear support bracket includes an internally threaded aperture defined through the lower surface thereof, wherein the internally threaded aperture extends into the circular bore of the rear support bracket, the internally threaded aperture is adapted to threadably receive a manually adjustable screw, the manually adjustable screw being tightened until a lower end thereof engages a flat contact surface of a recess defined in the horizontal member of the posterior C-shaped member, thereby securing the posterior C-shaped member into a locked position.

16. The golf ball dispensing and teeing device of claim 14, wherein the circular bore of the front support bracket is sized so as to slidably receive in a snug-fit manner the anterior C-shaped member, the leg of the anterior C-shaped member is inserted through the circular bore of the front support bracket and is extended therethrough until the horizontal member of the anterior C-shaped member is positioned centrally inside the circular bore of the front support bracket, the anterior C-shaped member rotates in relation to the ball supply tube, thereby allowing the anterior C-shaped member to be rotatably positioned rearward in order to facilitate compact storage and transport.

17. The golf ball dispensing and teeing device of claim 16, wherein the front support bracket includes an internally threaded aperture defined through the lower surface thereof, wherein the internally threaded aperture extends into the circular bore of the front support bracket, the internally threaded aperture is adapted to threadably receive a manually adjustable screw, the manually adjustable screw being tightened until a lower end thereof engages a flat contact surface of a recess defined in the horizontal member of the anterior C-shaped member, thereby securing the anterior C-shaped member into a locked position.

18. A golf ball dispensing and teeing device comprising:

an elongated ball supply tube, the ball supply tube is adapted to hold a plurality of golf balls, the ball supply tube defines an open anterior end opposing an open posterior end, the ball supply tube is cylindrical and has an inner diameter being slightly larger than a diametrical measure of a golf ball;

an anchor mechanism, the anchor mechanism anchors the ball supply tube to a ground in an elevationally-declined orientation with respect to the ground;

a ball release mechanism, the ball release mechanism permits a single golf ball to be metered from the ball supply tube, the ball release mechanism is welded or otherwise suitably mounted to an upper, external circumferential sidewall of the ball supply tube proximal to the open anterior end thereof, the ball release mechanism comprises:

an upper elongated jaw portion hingedly attached via a spring to a lower elongated jaw portion, the lower elongated jaw portion has a bottom side welded or otherwise suitably mounted to the upper, external circumferential sidewall of the ball supply tube proximal to the open anterior end thereof, the upper elongated jaw portion includes an anterior end opposing a posterior end, wherein the anterior end of the upper elongated jaw portion overhangs the lower elongated jaw portion, the posterior end of the upper elongated jaw portion includes a sleeve affixed therearound so as to protect an outer finish of a golf club head, the sleeve being constructed of a plastic or rubber material;

a stop member, the stop member limits the second generally horizontal position of the upper elongated jaw portion, the stop member is mounted atop the lower elongated jaw portion, posterior to the spring and underneath the upper elongated jaw portion, the stop member makes contact with the upper elongated jaw portion when the upper elongated jaw portion is lowered a sufficient distance; and an elongated abutment member, the abutment member extends downward angularly from the upper elongated jaw portion along the anterior end thereof, the abutment member extends from the upper elongated jaw portion at an angle of approximately 10°, wherein the abutment member extends a linear distance through a circular opening defined through the upper, external circumferential sidewall of the ball supply tube when the ball release mechanism is in a resting position, the circular opening is positioned fore of the lower elongated jaw portion, and wherein the abutment member engages a first golf ball of a series of golf balls positioned in single file and stacked formation within the ball supply tube, thereby preventing forward movement by the first golf ball when the ball release mechanism is in a resting position, the elongated abutment member functions as a stop to prevent the golf ball(s) from dispensing from the ball supply tube, and to facilitate release of a single golf ball through the open anterior end of the ball supply tube, the posterior end of the upper elongated jaw portion is depressed and quickly released, wherein depression of the posterior end of the upper elongated jaw portion concurrently urges the abutment member upwardly against an urging of the spring, and causing the abutment member to disengage from the first golf ball which allows the first golf ball to exit the open anterior end of the ball supply tube, roll slowly and simultaneously spin about its central axis down the parallel side rails and into the ball seat, within which the first golf ball resides in a resting position, and wherein release of the upper elongated jaw portion allows the spring to urge the abutment member downwardly, thereby causing the abutment member to engage a subsequent golf ball of the series of golf balls and preventing the subsequent golf ball from dispensing from the ball supply tube; and a golf ball tee apparatus, the golf ball tee apparatus is aligned juxtaposed to the open anterior end of the ball supply tube so as to be aligned facially therewith, the golf ball tee apparatus comprising:

a base having an upper surface densely populated with flexible, fibrous bristles of suitable rigidity so as to extend upright in a vertical direction, the fibrous bristles, being densely populated, form a bed of fibrous bristles having a bristle surface, the bristle surface supports a golf ball, thereby forming a hitting surface for striking golf balls, the bristle surface supports and catches the golf ball such that the golf ball seats in a fixed position atop the bristle surface after the golf ball exits the anterior end of the ball supply tube, the base includes a plurality of holes defined through corners thereof;

an anchor means inserted respectively through the plurality of holes in the base and into the ground, thereby anchoring the golf ball tee apparatus to the ground; and at least one platform having an equal area as the base, the at least one platform is placed and aligned against a lower surface of the base, the at least one platform defines a greater height than a height of the base, the at least one platform is provided with a plurality of holes which align with the plurality of holes in the base when the base and the at least one platform are engaged in a stacked configuration, the anchor means are inserted through the plurality of holes in the base and through the plurality holes in the at least one platform and into the ground.

* * * * *